US008534391B2

(12) United States Patent
Wirth

(10) Patent No.: US 8,534,391 B2
(45) Date of Patent: Sep. 17, 2013

(54) CUTTING ELEMENTS AND EARTH-BORING TOOLS HAVING GRADING FEATURES

(75) Inventor: Sean W. Wirth, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 575 days.

(21) Appl. No.: 12/106,979

(22) Filed: Apr. 21, 2008

(65) Prior Publication Data

US 2009/0260877 A1 Oct. 22, 2009

(51) Int. Cl.
*E21B 12/02* (2006.01)
*E21B 10/46* (2006.01)

(52) U.S. Cl.
USPC ..... 175/426; 175/39

(58) Field of Classification Search
USPC ..... 175/39, 426, 434, 420.1, 420.2
See application file for complete search history.

(56) References Cited

U.S. PATENT DOCUMENTS

| | | | | |
|---|---|---|---|---|
| 2,468,905 | A * | 5/1949 | Warren, Jr. | 175/39 |
| 3,260,579 | A * | 7/1966 | Scales et al. | 428/557 |
| 3,853,184 | A | 12/1974 | McCullough | |
| 4,818,153 | A * | 4/1989 | Strandell et al. | 407/113 |
| 4,886,009 | A | 12/1989 | Gondar et al. | |
| 4,984,940 | A * | 1/1991 | Bryant et al. | 407/119 |
| 6,003,623 | A * | 12/1999 | Miess | 175/430 |
| 6,167,833 | B1 | 1/2001 | Caraway et al. | |
| 6,250,295 | B1 | 6/2001 | Chanton et al. | |
| 6,293,980 | B2 * | 9/2001 | Wei et al. | 51/298 |
| 6,401,844 | B1 * | 6/2002 | Doster et al. | 175/432 |
| 6,443,248 | B2 | 9/2002 | Yong et al. | |
| 6,457,566 | B1 | 10/2002 | Toby | |
| 6,922,916 | B1 | 8/2005 | Potter | |
| 7,011,126 | B2 | 3/2006 | Heinen | |
| 7,021,872 | B2 | 4/2006 | Hauptmann et al. | |
| 2008/0056835 | A1 * | 3/2008 | Astrand et al. | 408/144 |

OTHER PUBLICATIONS

Ekstrand, Asa, et al., Homogeneous WC-Co-Cemented Carbides From a Cobalt-Coated WC Powder Produced by a Novel Solution-Chemical Route, J. Am. Ceram. Soc., Jan. 6, 2007, Manuscript No. 22245, 6 pages.

* cited by examiner

*Primary Examiner* — Kenneth L Thompson
(74) *Attorney, Agent, or Firm* — Traskbritt

(57) ABSTRACT

Earth-boring tools include one or more cutting elements having at least one grading feature positioned a known distance from an initial working surface of the cutting element. Methods of grading cutting element loss on earth-boring tools include comparing locations of wear surfaces on cutting elements to locations of one or more grading features in or on the cutting elements. In some embodiments, a cutting element may comprise an insert having a generally cylindrical body, a substantially planar cutting face surface, a substantially arcuate side surface, and at least one grading feature. In additional embodiments, a cutting element may comprise a tooth having one or more grading features.

24 Claims, 6 Drawing Sheets

CUTTING ELEMENTS AND EARTH-BORING TOOLS HAVING GRADING FEATURES

TECHNICAL FIELD

The invention relates generally to methods and devices that facilitate the evaluation of cutting element loss for earth-boring tools. More particularly, embodiments of the invention relate to cutting elements for earth-boring tools, the cutting elements having at least one grading feature that indicates an amount of cutting element loss. Embodiments of the invention additionally relate to methods of determining an amount of cutting element loss for an earth-boring tool.

BACKGROUND

In the drilling industry, obtaining timely and accurate drilling information is a valuable tool in facilitating the efficient and economical formation of a bore hole. One way to obtain drilling information is by examining the earth-boring tool after it has been removed from the bore hole. This process is known in the oil drilling industry as "dull bit grading," a process that has been standardized by the International Association of Drilling Contractors (IADC) Grading System.

The IADC Grading System uses a scale from zero to eight (0-8) to describe the condition of the cutting elements of an earth boring bit. For example, a steel toothed bit may have a measure of lost tooth height ranging from zero (no loss of tooth height) to eight (total loss of tooth height). Although this system provides standardization to the grading of dull bits and has the potential to provide valuable information to drillers, there are many shortcomings.

The system requires visual inspection of the bit and a subjective evaluation of cutting element loss based on the visual inspection. It may be difficult to determine the amount of cutting element loss due to wear and/or breakage by visual inspection alone. For example, cutting element loss may be difficult to quantify as the original shape of the cutting element may not be readily apparent when inspecting the dull tool. Even if the original cutting element shape is known, it may still be difficult to determine the amount of wear as the cutting element may have a rounded shape and/or the wear may be distributed over a large area of the cutting element. Some measurement tools have been developed to assist in determining cutting element loss, but they are often difficult to use, especially for an inexperienced operator. Additionally, even with the use of measurement tools, a significant amount of time may be required to determine an estimated amount of cutting element loss, and the estimated amount of cutting element loss may not be accurate.

If the amount of cutting element loss is not estimated accurately, the actual dull condition of the bit may not be accurately determined using the IADC Grading System. An improper determination of bit wear may result in a misdiagnosis of downhole conditions that may cause additional difficulty, waste, and/or expense in subsequent drilling with the tool that could have been avoided with an accurate evaluation of the dull bit.

In view of the shortcomings of the art, it would be advantageous to provide devices and methods that would facilitate an efficient, accurate, and objective determination of cutting element loss for earth-boring tools. Additionally, it would be advantageous to provide devices and methods that would facilitate the efficient and accurate objective determination of cutting element loss using visual inspection, and optionally without requiring use of separate measurement tools.

BRIEF SUMMARY OF THE INVENTION

In some embodiments, an earth-boring tool may comprise at least one cutting element having one or more grading features positioned a known distance from an initial working surface of the cutting element.

In other embodiments, the formation of a cutting element for an earth-boring tool may comprise forming at least one grading feature in a cutting element and locating the at least one grading feature at a predetermined distance from an initial working surface of the cutting element.

In other embodiments, an earth-boring tool may be graded by a method comprising correlating relative locations of a wear surface and a grading feature in a cutting element to an amount of cutting element loss.

In other embodiments, a cutting insert may comprise a generally cylindrical body, a substantially planar cutting face surface, a substantially arcuate side surface, and at least one grading feature. The grading feature, or grading features, may be positioned at a known distance or at known distances from at least one of the cutting face surface and the side surface.

In additional embodiments, a cone for an earth-boring bit may comprise a cone body and a plurality of teeth thereon. Each tooth may have a base and a tip. The base of each tooth may be joined to the cone body or formed on a part thereof, and the tip of each tooth may be distally located relative to the cone body. One or more grading feature may be positioned a known distance from at least one of the tip and the base of at least one tooth of the plurality of teeth.

DETAILED DESCRIPTION

Figure 1:
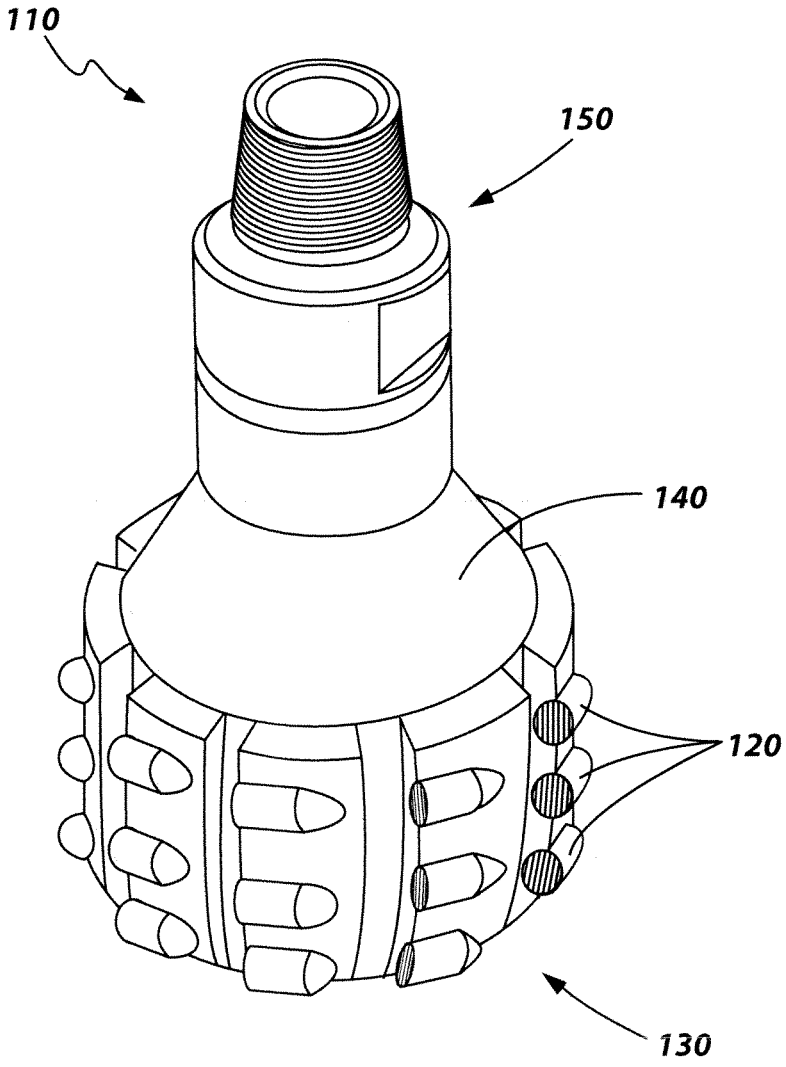
FIG. 1 is a perspective view of a fixed cutter earth-boring rotary drill bit, according to an embodiment of the present invention.
Figure 2:
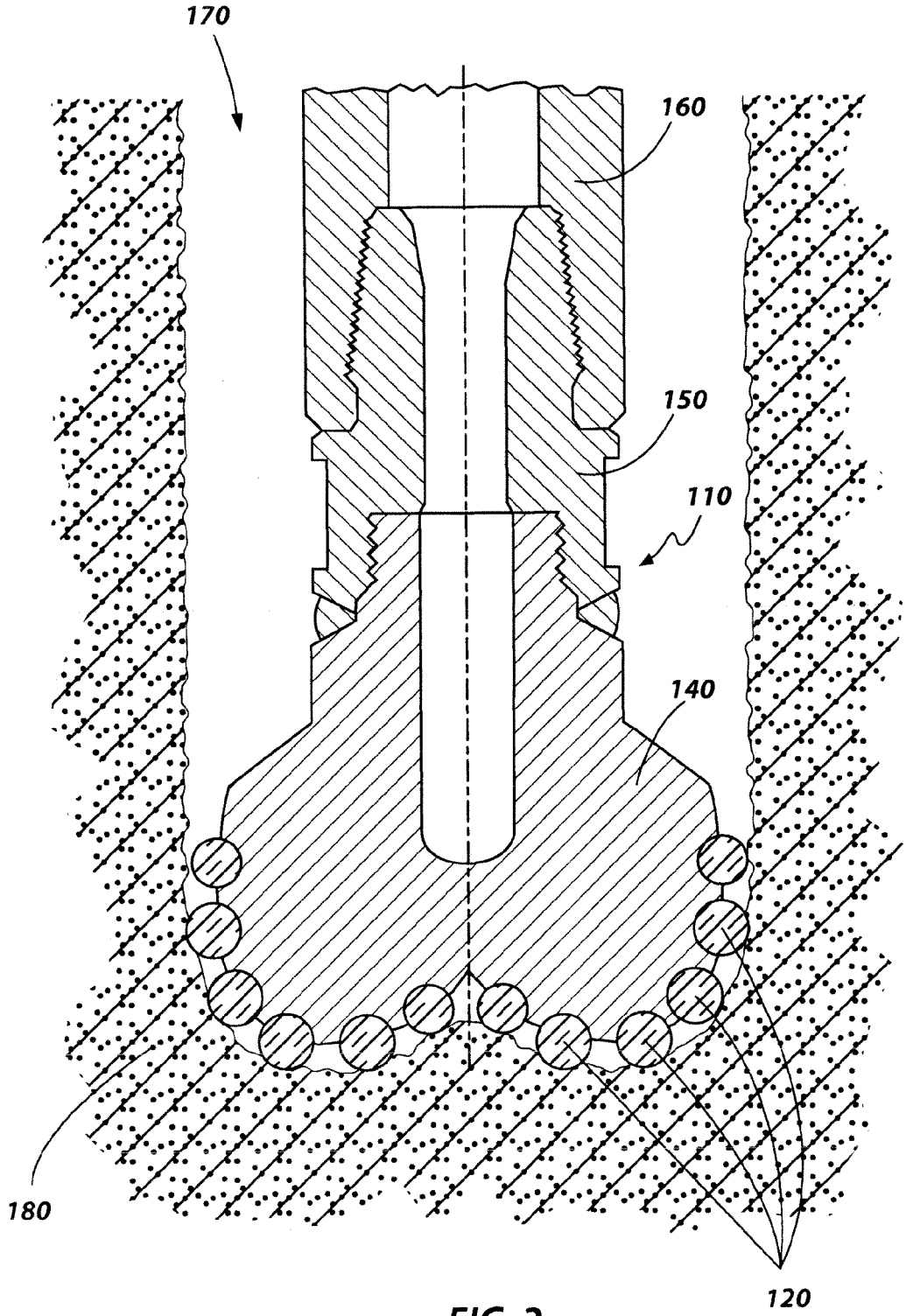
FIG. 2 is a cross-sectional view of the earth-boring rotary drill bit shown in FIG. 1 and illustrates the drill bit attached to a drill string and positioned at the bottom of a well bore.

An example of an earth-boring rotary drill bit 110 according to the present invention is shown in FIGS. 1 and 2. This example of a rotary drill bit is a fixed-cutter bit (often referred to as a "drag" bit), which includes a plurality of cutting elements 120 secured to a face region 130 of a bit body 140. The cutting elements 120 may have one or more grading features as described in further detail below. The bit body 140 may be secured to a shank 150, as shown in FIGS. 1 and 2, which may be used to attach the bit body 140 to a drill string 160 (FIG. 2). In some embodiments, the cutting elements 120 may be secured to a plurality of wings or blades that are separated from one another by fluid channels and junk slots, as known in the art.

Referring to FIG. 2, the drill bit 110 may be attached to a drill string 160 during drilling operations. For example, the earth-boring rotary drill bit 110 may be attached to a drill string 160 by threading the shank 150 to the end of a drill string 160. The drill string 160 may include tubular pipe and equipment segments coupled end to end between the drill bit 110 and other drilling equipment, such as a rotary table or a top drive (not shown), at the surface. The drill bit 110 may be positioned at the bottom of a well bore 170 such that the cutting elements 120 are in contact with the earth formation 180 to be drilled. The rotary table or top drive may be used for rotating the drill string 160 and the drill bit within the well bore 170. Alternatively, the drill bit may be coupled directly to the drive shaft of a down-hole motor, which then may be used to rotate the drill bit, alone or in conjunction with surface rotation. Rotation of the drill bit under weight on bit (WOB) causes the cutting elements 120 to scrape across and shear away the surface of the underlying formation 180.

Such cutting elements 120 may have an initial shape, and may be located on the drill bit 110 in a position, such that a portion of the exterior surface of the cutting element 120 interacts with an earth formation 180 in a crushing, scraping, shearing, and/or abrasive manner as the earth-boring tool is driven into the earth formation 180. This portion of the surface of the cutting element 120 may be called the working surface. As the working surface of the cutting element 120 interacts with an earth formation 180 the initial working surface, that is the working surface of a new and unworn cutting element 120, may be worn away. This wear or loss of cutting element 120 may be a result of abrasion caused by the earth formation 180, debris, and/or drilling mud. Additionally, wear or loss of cutting element 120 may result from high compressive or tensile forces acting on the cutting element 120, which may cause the cutting element 120 to chip, break, and/or become dislodged from the earth-boring tool. As material is lost from the initial working surface of a cutting element 120, a wear surface, often termed a "wear flat" or a "wear scar," may be formed. A wear surface is a surface of a worn cutter that is comprised of material that was initially internal to the cutter, but has been exposed due to wear, forming a new external surface of the cutting element 120.

An earth-boring tool according to the present invention, such as the fixed cutter bit shown in FIGS. 1 and 2, may comprise at least one cutting element 120 having at least one grading feature positioned a known distance from an initial working surface of the at least one cutting element 120. Examples of such cutting elements will be described below. Although many of these examples describe generally cylindrical cutting elements, these are illustrative of any number of configurations such as, for example, oval shaped cutting elements, tombstone-shaped cutting elements, triangular-shaped cutting elements and rectangular-shaped cutting elements. Additionally, the present invention encompasses cutting elements 120 comprising various combinations of materials, shapes and sizes.

Figure 3:
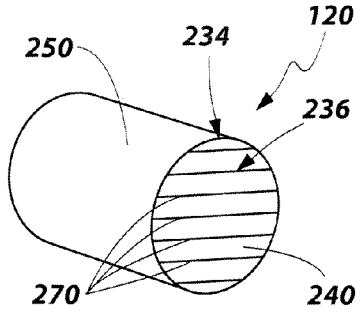
FIG. 3 is a perspective view of a cutting element wherein a grading feature may comprise a surface feature of the cutting element according to an embodiment of the present invention.

FIG. 3 shows a close-up view of a cutting element 120 of the earth-boring drill bit 110 shown in FIGS. 1 and 2. For illustrative purposes the cutting element 120 is not shown secured to the face region 130 of the bit body 140, as it may be during normal use. The cutting element 120 includes grading features 236 that may facilitate the dull grading of the earth-boring drill bit 110. As shown in this example, the grading features 236 may comprise one or more surface features formed in or on an exterior surface of the cutting element 120. The general shape of the cutting element 120 may be substantially cylindrical and may comprise a cutting face surface 240 and an arcuate side surface 250. For example, one or more indentations may be formed in a surface of the cutting element 120 a known distance from an initial working surface 234 to form at least one grading feature 236 in the cutting element 120. For example, a plurality of substantially straight and substantially parallel grooves 270 may be formed in a surface of the at least one cutting element 120 to form grading features 236 in the cutting element 120. As shown in this embodiment, the substantially straight and substantially parallel grooves 270 may be formed in the cutting face surface 240, which comprises a working surface 234, of the cutting element 120. The cutting element 120 may be positioned and oriented on an earth-boring tool such that the grading features 236 formed in the cutting face surface 240 of the cutting element 120 are substantially parallel to the working surface of the cutting element 120, each of the grading features 236 being positioned a known distance from the initial working surface 234. This may assist in the dull grading of the earth-boring tool, after the earth-boring tool has been worn by use.

Figure 4:
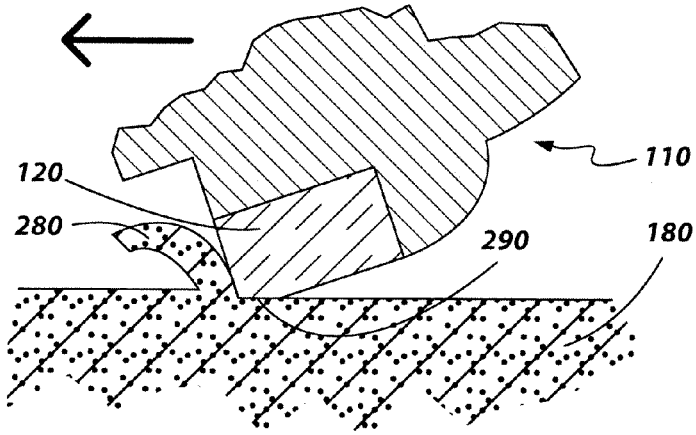
FIG. 4 is a cross-sectional view of the cutting element of FIG. 3 and shows the cutting element interacting with an earth formation.

As shown in FIG. 4, during drilling, the cutting element 120 may be scraped across an earth formation 180 (the direction of travel is indicated by the arrow in the figure) such that the cutting element 120 removes cuttings 280 from the earth formation 180. As the cutting element 120 interacts with the earth formation 180, the cutting element 120 may wear and a wear surface 290, which is often termed a "wear flat" or "wear scar" by those of ordinary skill in the art, may be formed.

Figure 5:
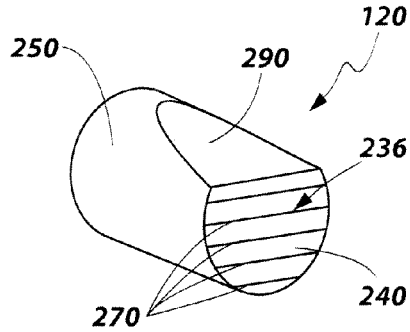
FIG. 5 is a perspective view of the cutting element of FIG. 3 and illustrates the cutting element in a worn state after use.

FIG. 5 shows the cutting element 120 of FIG. 3 in a worn state, having a portion of the initial working surface 234 (FIG. 3) worn away and a wear surface 290 formed therein. When the earth-boring tool and the cutting elements 120 thereof are in a worn state, the grading features 236 included in the cutting element 120 may facilitate the dull grading of the worn earth-boring tool. For example, the relative location of the wear surface 290 to one or more of the grading features 236 may be correlated to an amount of cutting element 120 loss or wear. As shown in FIG. 5, the cutting element 120 may have worn beyond one or more grading features 236 in the cutting element 120. Additionally, the wear surface 290 may extend to a location proximate a grading feature 236. The known location of one or more grading features 236 proximate the wear surface 290 may indicate the current location of the wear surface 290 or current working surface relative to the initial working surface 234 and facilitate the evaluation of cutting element 120 wear or loss. Additionally, the wearing away of one or more grading features 236 may indicate that the cutting element 120 has worn past a known location relative to the initial working surface 234 and may be correlated to an amount of cutting element 120 wear or loss.

The determination of cutting element 120 loss may then facilitate the dull grading of the earth-boring tool, which may be useful in determining down-hole conditions experienced by an earth-boring tool. The knowledge of down-hole conditions may be used to determine if any drilling parameters may be adjusted to more efficiently form the borehole. For example, the WOB, the rotations per minute (RPM), the type of earth-boring tool, the hydraulic pressure and flow parameters of drilling mud, and many other parameters may be adjusted for more efficient drilling with the knowledge of down-hole conditions. Additionally, the determination of cutting element 120 loss may be used to determine the condition of the earth-boring tool itself, and whether the earth-boring tool may be used in resumed operation, if the earth-boring tool should be discarded, or if the earth-boring tool should be repaired.

Figure 6:
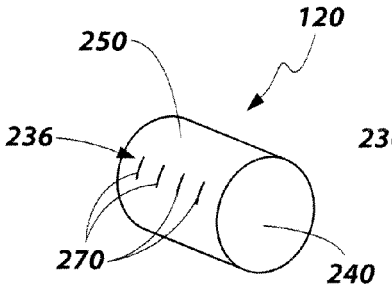
FIG. 6 is a perspective view of a cutting element having grading features comprising surface features formed in an arcuate side surface thereof according to an embodiment of the present invention.

In additional embodiments, as shown in FIG. 6, a cutting element 120 may have grading features 236 that comprise surface features formed in or on an arcuate side surface 250 of the cutting element 120. For example, the cutting element 120 may have grooves 270 formed in substantially parallel lines in the arcuate side surface 250 thereof. In another example, shown in FIG. 7, grooves 270 may be formed in substantially parallel lines that partially or completely circumscribe the cutting element 120, forming longitudinally spaced rings around the cutting element 120. Grading features 236 located in a side surface of a cutting element may facilitate the dull grading of an earth-boring tool in a generally similar manner to grading features 236 located on the cutting face surface 240. For example, the location of a wear surface 290 may be compared to the location of a grading feature 236 located on an arcuate side surface 250 of the cutting element 120 and the relative locations may be correlated to evaluate an amount of cutting element 120 loss.

Figure 7:
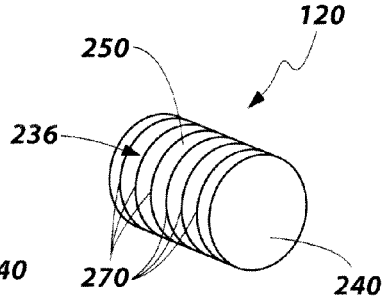
FIG. 7 is a perspective view of a cutting element having grading features comprising grooves formed in substantially parallel lines that circumscribe the cutting element according to an embodiment of the present invention.

In yet further embodiments of the present invention, cutting elements 120 may have grading features 236, such as a groove 270 on or in both the cutting face surface 240, as shown in FIG. 5, as well as the arcuate side surface 250, as shown in FIGS. 6 and 7.

Figure 8:
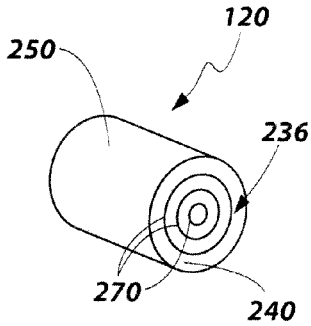
FIG. 8 is a perspective view of a cutting element having grading features comprising grooves arranged in substantially concentric rings formed in the cutting face surface according to an embodiment of the present invention.

FIG. 8 shows a cutting element 120 having grading features 236 comprising grooves 270 arranged in substantially concentric rings formed on or in the cutting face surface 240 of the cutting element 120. The rings may be concentric to a longitudinal axis of the cutting element 120, such that each grading feature 236 is located a known radial distance from an initial side surface of the cutting element 120 regardless of the cutting element's 120 rotational orientation relative to the body of the earth-boring tool to which it is attached.

Figure 9:
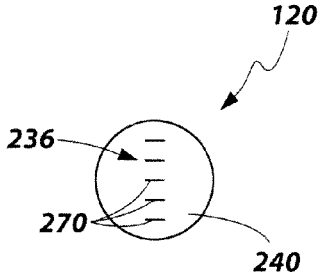
FIGS. 9-13 are front views of grading features formed in a face surface of a cutting element according to embodiments of the present invention.
Figure 10:
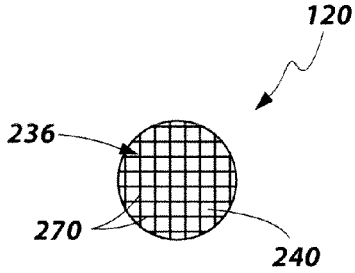
Figure 11:
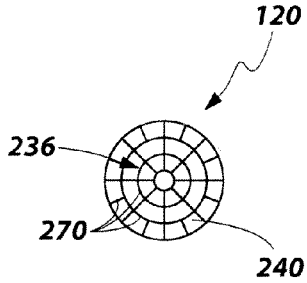
Figure 12:
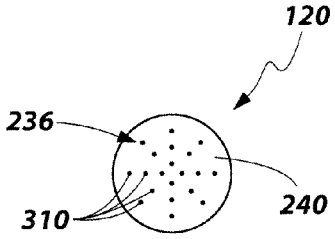
Figure 13:
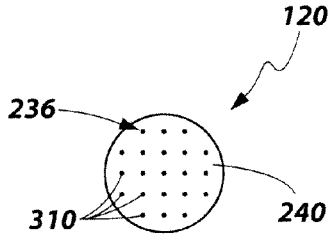

Additional examples of grading features 236 formed on or in the cutting face surface 240 of a cutting element 120 are shown in FIGS. 9-13. The examples in FIGS. 9-11 show grading features 236 that may comprise grooves 270 (or ridges) formed in (or on) a face surface of the cutting element 120. The examples shown in FIGS. 12 and 13 illustrate grading features 236 that comprise a plurality of recesses 310 (or protrusions) formed in (or on) a cutting face surface 240 of a cutting element 120 are shown. Additionally, the grading features 236 described herein may be used in combination. For example, a cutting element 120 may include grading features 236 on both an arcuate side surface 250 and a cutting face surface 240. In addition to grading features 236 comprising surface features in a cutting element 120, a cutting element 120 may also include grading features 236 comprising internal features in the cutting element 120, as discussed below.

In some embodiments of the invention, an earth-boring tool may have at least one cutting element 120 that has one or more grading features 236 that comprise material volumes that are visually distinct one from another. As used herein, elements that are "visually distinct" from one another are elements having at least one spatial boundary that can be visually observed by a person inspecting the elements (either with the naked eye or with the aid of magnification).

Figure 14:
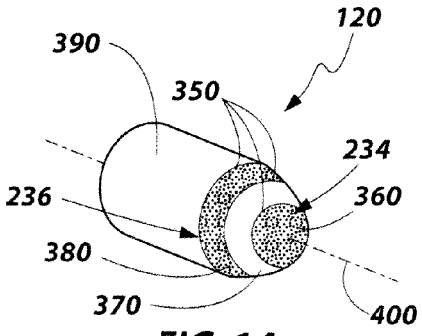
FIG. 14 is a perspective view of a cutting element having a grading feature comprising a first material volume and a second material volume adjacent the first material volume that are visually distinct from one another according to an embodiment of the present invention.

As shown in FIG. 14, an insert type cutting element 120, such as may be used in a roller cone bit with a base thereof received in an aperture in a side of a roller cone, may have a grading feature 236 that comprises a first material volume 360 and at least a second material volume 370 that is visually distinct from the first material volume 360 and located adjacent the first material volume 360. The cutting element 120 shown in FIG. 14 also includes a third material volume 380 and a fourth material volume 390. The material volumes of the cutting element 120 may be arranged in a layered manner and the interface 350 between each material volume may be substantially perpendicular to a longitudinal axis 400 of the cutting element 120. Each material volume may be visually distinct from one or more adjacent material volumes. For example, the second material volume 370 may exhibit a color different than a color exhibited by the first material volume 360. A difference in "color," as such term is used herein, includes but is not limited to a difference in hue, shade, saturation, value, brightness, gloss, texture and/or tint. Optionally, non-adjacent material volumes, such as the first material volume 360 and the third material volume 380, or the second material volume 370 and the fourth material volume 390, may be formed from visually identical material and may be the same color. The grading feature 236 or features may comprise one or more interfaces 350 between adjacent material volumes, such as the interface 350 between the first material volume 360 and the second material volume 370. The interface 350 may be visually perceptible and may be located a known distance from an initial working surface 234 of the cutting element 120. The grading features 236 comprising visually distinct material volumes may facilitate the evaluation (e.g., quantification) of loss of cutting element 120 when the cutting element 120 is in a worn state, and may facilitate the dull grading of a worn earth-boring tool.

Figure 15:
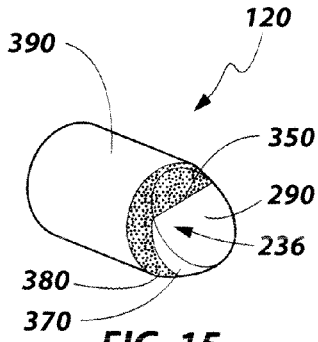
FIG. 15 is a perspective view of the cutting element of FIG. 14 and illustrates the cutting element in a worn state after use.

FIG. 15 shows the cutting element 120 of FIG. 14 in a worn state such that the cutting element 120 includes a wear surface 290. The first material volume 360 has been worn away and lost, and the second material volume 370 has been significantly worn. Additionally, the interface 350 between the second material volume 370 and the third material volume 380 is visible on the wear surface 290. The known locations of the material volumes 360, 370, 380, and 390 and the interfaces 350 between the material volumes 360, 370, 380, and 390 may be correlated with the location of the wear surface 290 and may facilitate the determination (e.g., quantification) of loss of cutting element 120.]

Figure 16:
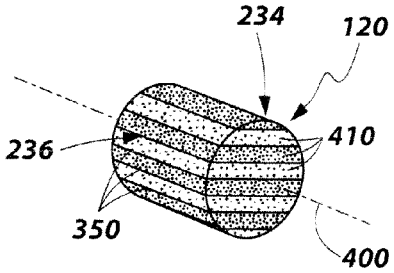
FIGS. 16 and 17 are perspective views of cutting elements having a grading feature comprising a plurality of material volumes arranged in layers.
Figure 17:
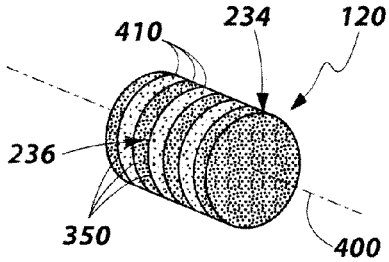

FIGS. 16 and 17 show cutting elements 120 with grading features 236 comprising interfaces between adjacent material volumes 410, which may be arranged in layers. Each material volume 410 is visually distinct from adjacent material volumes 410. The layers may be arranged in a number of configurations. For example, each material volume 410 layer may be at least substantially planar and oriented parallel to a longitudinal axis 400 of the cutting element 120, as shown in FIG. 16. In other embodiments, each material volume 410 layer may be at least substantially planar and oriented perpendicular to a major axis 400 of the cutting element 120, as shown in FIG. 17. Each material volume 410 layer may have a substantially similar thickness, or the material volume 410 layers may have different thicknesses. The cutting element 120 may be oriented on the body of an earth-boring tool such that each material volume 410 layer and/or each interface 350 between material volumes 410 is located at a known location relative to the initial working surface 234 of the cutting element 120. After the tool has been worn, the grading features 236, including each material volume 410 layer and/or each interface 350, may then be used to facilitate the determination of cutting element 120 loss and to grade the dull earth-boring tool to which it was secured.

Figure 18:
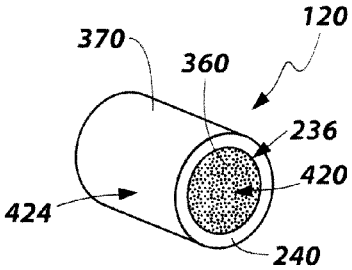
FIGS. 18 and 19 are perspective views of cutting elements having a grading feature that comprises a core formed from a first material volume and an adjacent layer formed from at least a second material volume according to embodiments of the present invention.

FIG. 18 shows a cutting element 120 with a grading feature 236 comprising an interface between a core 420 formed from a first material volume 360 and an adjacent layer 424 formed from a second material volume 370, the second material volume 370 is visually distinct from the first material volume 360. The core 420 may be substantially cylindrical, and may extend to and comprise a portion of the cutting face surface 240 of the cutting element 120. In additional embodiments, as shown in a worn state in FIG. 19, a core 420 of a first material or some other object may be embedded in the cutting element 120 and initially may be completely internal to the cutting element 120, but may become exposed through cutting element 120 loss.

Figure 19:
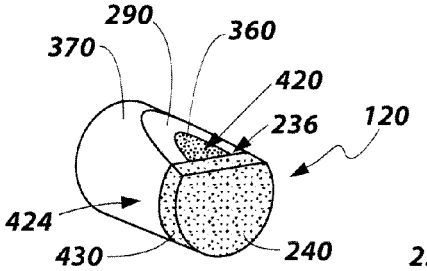

For example, the cutting element 120 may have a diamond table 430 as shown in FIG. 19 or other hard material forming the cutting face surface 240, such that the core 420 may not be initially visible in the cutting face or the arcuate side surface 250. In such configurations, the core 420 may be visible only in a wear surface 290. Accordingly, it is contemplated that, by way of non-limiting example, the cutting element embodiments of at least FIGS. 3, 6-13, and 16-20 may comprise a polycrystalline diamond compact (PDC) table 430 formed or otherwise secured to a longitudinal end of a cutting element 120, by techniques well known to those of ordinary skill in the art. In such instances, some or all grading features 236 may or may not be initially visible on a cutting element 120, or may be visible only upon wear thereof, such as for example, wear of the diamond table 430 and the supporting substrate, forming a wear flat or wear scar extending from the cutting face surface 240 along a side of cutting element 120. Furthermore, cutting elements 120 in the form of inserts as depicted in FIG. 14, may be preformed and then partially covered with a superabrasive material, such as a layer of polycrystalline diamond, the diamond layer obscuring some or all of the grading features until wear of cutting element 120 occurs.

Figure 20:
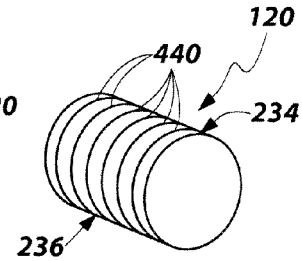
FIG. 20 is a perspective view of a cutting element having a grading feature that comprises one or more films within the cutting element according to an embodiment of the present invention.

In additional embodiments, a cutting element 120 may include at least one grading feature 236 that comprises one or more films 440 within the cutting element 120, as shown in FIG. 20. Each film 440 may comprise a relatively thin layer of material that is visibly distinct from the material of the cutting element 120 on either side thereof. The cutting element 120 may be formed such that one or more films 440 may be located a known distance from an initial working surface 234 of the cutting element 120. For example, a film may be a different color than a color of an adjacent material volume. The cutting element 120 loss of the worn cutting element 120 may then be determined by correlating the location of a wear surface in the cutting element 120 relative to the location of one or more of the films 440 in the cutting element 120.

There are a variety of methods to form the insert type cutting elements 120 with grading features 236 previously described herein. Grading features 236 may be formed during the manufacture of the cutting element 120, or they may be formed in or on a cutting element 120 after forming the cutting element 120 itself.

An insert type cutting element 120, such as, for example, a cemented carbide insert or a substrate for a polycrystalline diamond compact (PDC) insert for a roller cone bit or a cemented carbide insert or a substrate for a PDC cutting element for a fixed cutter bit, may be formed using powder compaction and sintering process. Such cemented carbide bodies may comprise a particle-matrix composite material comprising hard carbide particles (e.g., tungsten carbide particles) dispersed within a metal matrix material (e.g., a metal such as cobalt or an alloy thereof). In this process, the hard particles and particles of the matrix material may be milled together with an organic binder material in a rotating ball mill to prepare a precursor powder mixture. The precursor powder may then be spray dried or otherwise formed into small clusters or agglomerates that may be, for example, about 100 μm in size. The agglomerates of the precursor powder mixture may then be pressed together in a mold to form a green body. The green body may then be exposed to a hydrogen-containing atmosphere at about 750° F. (400° C.) wherein the organic binder material may be removed. After the organic binder material has been removed, the green body may be sintered in a furnace at elevated temperatures (e.g., approximately 2640° F. (1450° C.) for cobalt matrix material). Optionally, the green body may be heated and partially sintered to form a brown body before it is heated to a fully sintered state. The sintering process may result in the matrix particles joining together to form a substantially continuous matrix phase in which the hard particles are embedded.

During the manufacture of a cutting element formed by a powder compaction and sintering process, surface features may be formed in the cutting element by a variety of methods. For example, grading features 236 that comprise surface features such as bumps, indentations, grooves 270, and/or recesses 310 may be formed in the surface of a cutting element by providing one or more complementary features in a mold 460 so as to impart bumps, indentations, grooves 270, and/or recesses 310 in the green body during powder compaction. In another example, grading features 236 that comprise surface features such as bumps, indentations, grooves 270, and/or recesses 310 may be machined or otherwise formed in the surface of a green body or a brown body prior to sintering the green or brown body to a final density. In yet other embodiments, bumps, indentations, grooves 270, and/or recesses 310 may be machined in the fully sintered cutting element.

Additionally, grading features 236 that comprise a second material volume 370 that is visually distinct from a first material volume 360 in a cutting element may be formed during the manufacture of the cutting element. In one such process, a first precursor powder mixture and a second precursor powder mixture may be formed that are visually distinct from one another. Visual characteristics of a precursor powder mixture may be altered by altering the quantity or types of materials added to the precursor powder mixture. For example, the color of a precursor powder mixture may be affected by the addition of an inorganic pigment. A suitable inorganic pigment may comprise an oxide of one or more transition metal, such as chromium, cobalt, copper, nickel, iron, titanium and/or manganese. Volumes of a first and second precursor powder mixture may be pressed simultaneously or consecutively in a mold to form at least one grading feature in a cutting element, or may be preformed in layers or other segments and assembled in a mold and pressed.

Figure 21:
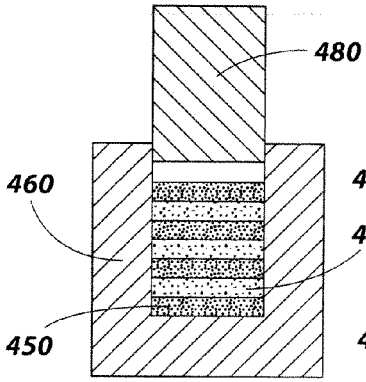
FIGS. 21-23 are cross-sectional schematic diagrams illustrating an embodiment of a method that may be used to form a cutting element having a grading feature.

As shown in FIG. 21, a cutting element 120 like that shown in FIG. 17 may be formed by providing a first layer comprising a first powder mixture 450 in a mold 460, and then providing a second layer comprising a second powder mixture 470 over the first layer. Additional layers may then be formed by alternating layers of the first and second powder mixtures 450, 470 in the mold 460. The powder mixtures 450, 470 may then be pressed together in the mold 460 by a piston 480 to form a green body, which may then be sintered to form a cutting element 120, such as that shown in FIG. 17. As noted above, the layers may comprise preformed segments configured as wafers or as other segments formed with mutually complementary surfaces for abutting assembly.

Figure 22:
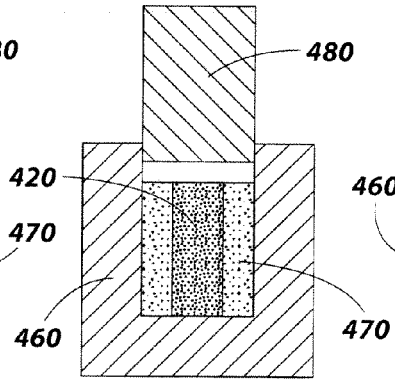
Figure 23:
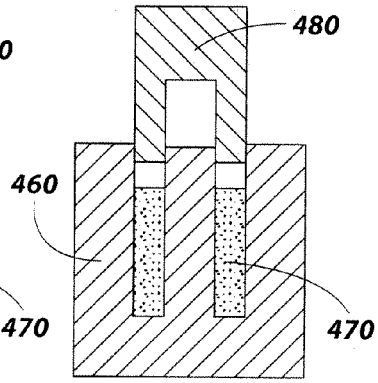
Figure 24:
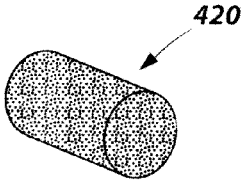
FIGS. 24 and 25 are perspective views of elements that may be used to form an embodiment of a cutting element having a grading feature according to the present invention.
Figure 25:
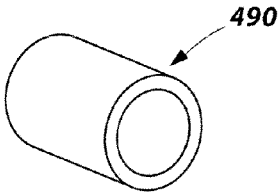

In other embodiments, cutting elements 120, such as those shown in FIGS. 18 and 19, may be formed by pressing a precursor powder mixture in a first mold 460 to form a generally cylindrical core element 420. As shown in FIG. 22, the core element 420 may then be positioned in a second larger generally cylindrical mold 460 and the core element 420 may be surrounded by at least a second precursor powder mixture 470. The core element 420 and the second precursor powder mixture 470 may then be pressed in the second larger mold 460 cavity to form a unified green body, which may then be sintered to form the cutting element 120. In other embodiments, a second precursor powder mixture 470 may be placed in an annular or tube shaped mold 460 cavity, as shown in FIG. 23, to form a separate annular element 490. The core element 420 shown in FIG. 24 and the annular element 490 shown in FIG. 25 then may be assembled such that the core element 420 is positioned within the annular element 490 in a configuration like that shown in FIG. 18. The core element 420 and the annular element 490 may then be sintered together to form a unified cutting element 120.

In another embodiment, a cutting element 120 such as that shown in FIG. 20 may be formed by providing a precursor powder mixture in a mold, and positioning one or more thin films 440 at selected locations in the precursor powder mixture within the mold. The precursor powder mixture and the thin films 440 may be pressed within the mold such that the thin films 440 become embedded in the resulting green body. The green body may then be sintered to form a cutting element 120 having at least one grading features 236 comprising one or more films embedded therein, as shown in FIG. 20. Furthermore, other spaced features may be used as grading features. For example, a series of preformed, mutually parallel posts or pins joined at ends thereof by a rod to form a comb-like element may be placed within a mold with the rod oriented longitudinally, the free ends of the posts on pins placed against the side wall of the mold, and powder poured thereabout. Upon pressing, the exposed post or pin ends will be visible to use as grading features.

In additional embodiments of the present invention, earth-boring tools may include integrated blade or tooth-like cutting elements having grading features therein.

Figure 26:
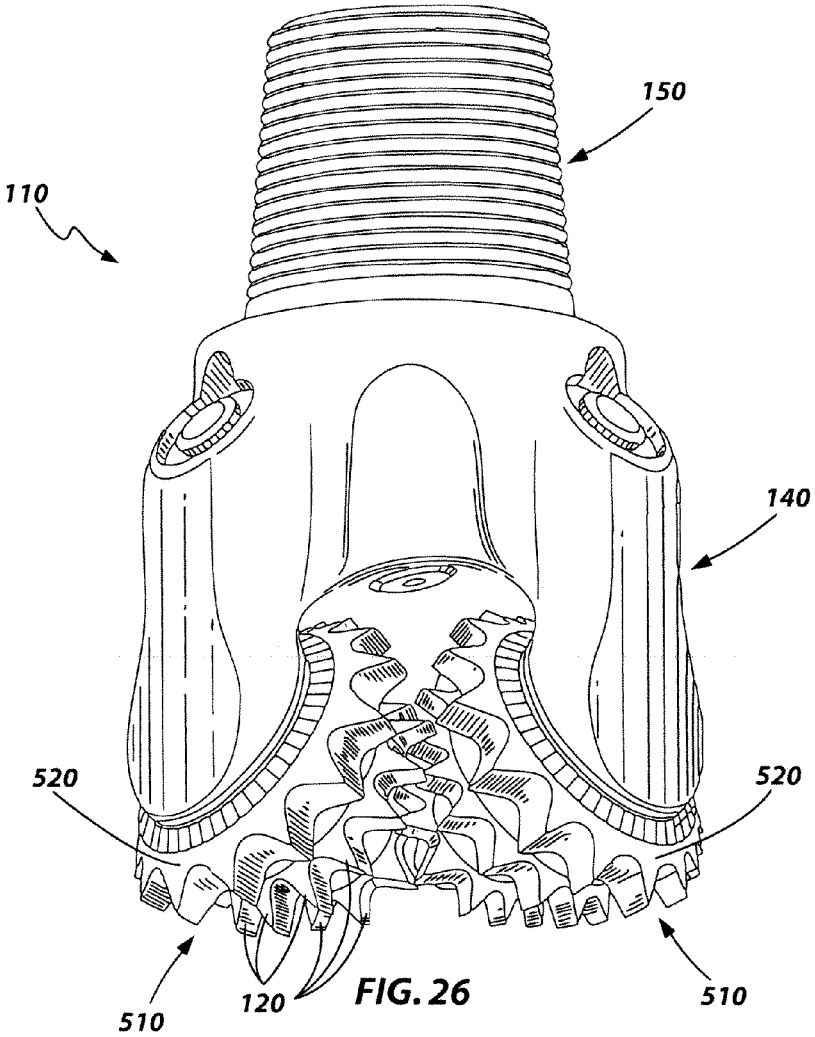
FIG. 26 is a perspective view of a tricone earth-boring rotary drill bit, according to an embodiment of the present invention.

FIG. 26 shows another example of an earth-boring rotary drill bit 110 according to the present invention. The earth-boring bit 110 shown in FIG. 26 is a roller cone bit, and more specifically, a tricone bit. A tricone bit may include a shank 150, a bit body 140 having three bit legs, and three cones 510 (of which only two are visible in FIG. 26). Each cone 510 may have a cone body 520 and may be rotatably mounted on a spindle that extends downward and radially inward from a bit leg of the bit body. In this configuration, each cone 510 may be configured to rotate about the spindle on which the cone body 520 is mounted during drilling. Each cone 510 may include a plurality of cutting elements 120 formed integrally therewith, such an element being generally identified as a "mill tooth" cone regardless of the manner in which it is fabricated. During drilling, the drill bit 110 may be rotated at the bottom of the well bore such that the cones 510 roll over the surface of the underlying formation in a manner that causes the cutting elements 120 on the cones 510 to crush, scrape, and/or shear away the surface of an underlying formation (not shown).

Figure 29:
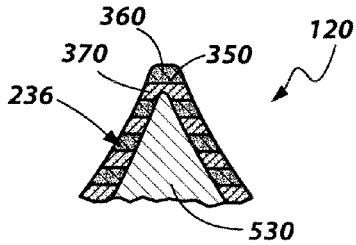
FIG. 29 is a cross-sectional view of a tooth having a grading feature comprising an interface between a first volume of hardfacing material and a second volume of hardfacing material according to an embodiment of the present invention.

In the embodiment shown in FIG. 26, the cutting elements 120 comprise cutting teeth that are formed by machining the outer surface of the cones 510. In such embodiments, each tooth may comprise a steel body 530 having a hardfacing material applied to the surface thereof, as shown in FIG. 29 and discussed in further detail below. The hardfacing material may include hard particles, such as diamond or tungsten carbide, dispersed within a metal or metal alloy matrix material. In additional embodiments, the cutting elements 120 may comprise cutting inserts similar to those previously discussed herein with reference to FIGS. 3 through 20, but configured (see FIGS. 14 and 15) as an insert for a roller cone bit. For example, such cutting inserts may have a domed or arcuate end surface, instead of a planar cutting face.

Figure 27:
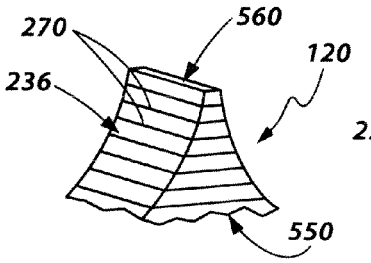
FIG. 27 is a perspective view of a tooth having a grading feature formed therein according to an embodiment of the present invention.

FIG. 27 shows a cutting element 120 or tooth having a grading feature 236 on a surface thereof. As shown in FIG. 27, the tooth has a base 550 and a tip 560, and as shown in FIG. 26, the base 550 of the tooth may be joined to a cone body 520 and the tip 560 of the tooth may be located distal the cone body 520. The tooth may have at least one grading feature 236 positioned a known and predetermined distance from the working surface or the tip 560 of the tooth. Optionally, at least one grading feature 236 may be positioned a known distance from the base 550 of the tooth. The grading features 236 may comprise, for example, an indentation such as a groove 270 provided in a surface of one or more of the teeth.

Figure 28:
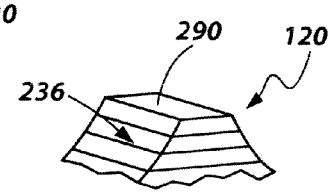
FIG. 28 is a perspective view of the tooth of FIG. 27 and illustrates the tooth in a worn state after use.

FIG. 28 shows the cutting element 120 or tooth of FIG. 27 in a worn state and including a wear surface 290. The dull grading of the earth-boring tool may be facilitated by the grading features 236 formed in the cutting element 120. Similar to insert-type cutting elements, the amount of tooth-like cutting element 120 loss may be determined by correlating the relative locations of the wear surface 290 formed on the cutting element 120 and one or more grading features 236 remaining in the cutting element 120, or by correlating the relative location of the wear surface 290 to grading features 236 that have been worn away from the cutting element 120.

FIG. 29 shows cutting element 120 or tooth having a grading feature 236 comprising an interface 350 between a first material volume 360 of hardfacing material and a second material volume 370 of hardfacing material. The second material volume 370 may be visually distinct from the first material volume 360. For example, the second material volume 370 may exhibit a color that is different from a color exhibited by the first material volume 360.

A cutting element 120 such as that shown in FIG. 29 may be formed by applying hardfacing material to a tooth element. The hardfacing may be applied using, for example, a thermal spraying process or an arc welding process (e.g., a plasma transferred arc process). For example, a transferred plasma arc may be established between an electrode and an area of the steel tooth element forming a plasma column of inert gas in the arc by passing an electrical current between the electrode and the steel tooth element. A powdered hardfacing material, which may comprise hard particles and a matrix material (for example, tungsten carbide particles and particles of matrix material), may then be fed into the plasma column. The plasma column may melt a localized portion of the tooth and may further melt the matrix material of the powdered hardfacing material as it is directed to and deposited on the tooth. As the materials cool and solidify, a particle-matrix composite hardfacing material is formed and welded to the exterior surfaces of the tooth. A first material volume of hardfacing may be deposited on the tooth at a first known location that is located a specified distance from at least one of the base of the tooth or the tip of the tooth. A second material volume of hardfacing material may then be applied adjacent the first hardfacing material. The second hardfacing material may be visually distinct from the first hardfacing material. For example, the second material volume of hardfacing material may have a different composition than the first material volume of hardfacing powder material, and the difference in composition may cause the two material volumes of hardfacing to be visually distinct. For example, a pigment (e.g., an inorganic pigment such as, for example, an oxide material) may be provided in at least one of the first and second material volumes of hardfacing, such that the second material volume of hardfacing exhibits a color that is different than a color exhibited by the first material volume of hardfacing.

Additionally, grading features 236 may be formed on cutting elements 120, such as those shown in FIGS. 3-13, 27, and 28, by forming one or more indentations, grooves 270 or recesses 310 in a surface of a cutting element 120. Indentations, grooves 270 or recesses 310 may be formed in the surface of a cutting element 120 by a variety of methods, including, but not limited to, chemical etching, mechanical etching (e.g., grinding, milling, drilling, turning or particle blasting), and laser etching.

In additional embodiments, surfaces of a cutting element may be treated such that specific surface regions may be visually distinct from adjacent surface regions to form one or more grading features on or in the surface of the cutting element. For example, a cutting element may have one or more surface regions exposed to at least one chemical that alters the appearance of the surface region exposed to the chemical, other surfaces being masked from the treatment chemical.

One or more reference materials may be provided with an earth-boring tool according to the present invention. For example, a printed card or pamphlet may be provided to facilitate the identification and location of grading features 236 in a new or worn cutting element 120. A reference material may be provided with an earth-boring tool, such as a bit, or may be made available upon request. For example, the reference material may be available over a computer network such as the internet. The reference material may be useful in identifying grading features 236 that may have worn away, and may be used to identify the location of a wear feature relative to an initial working surface 234. Additionally, the reference material may facilitate the correlation of the relative locations of a wear surface 290 and a grading feature 236 to an amount of cutting element 120 loss.

Grading features 236 in a cutting element 120 may also facilitate the determination of cutting element 120 loss from a remote location. For example, a photograph may be taken of a worn earth-boring tool with at least one cutting element 120 having one or more grading features 236 therein. The photograph could then be used to correlate the relative locations of a wear surface 290 and a grading feature 236 of a cutting element 120 to an amount of cutting element 120 loss. As used herein, the term "photograph" encompasses digital images which may be saved and forwarded electronically and analyzed digitally for a precise determination of an amount of cutting element loss.

While the present disclosure has been phrased in terms of one or more grading features positioned a known distance from an initial working surface of a cutting element, the term "initial working surface" encompasses and includes one or more reference points associated with that working surface. For example, a grading feature may be positioned a known longitudinal distance from a peripheral edge of a working surface comprising a cutting face surface or a side surface of diamond table, or from an interface between two adjacent working surfaces of a diamond table, or between a working surface of a diamond table and a surface of a supporting substrate. Further, a grading feature may be positioned a known distance from a particular point on an initial working surface, such as a reference point located at a lateral periphery of a cutting face surface.

Although embodiments of the invention have been described with reference to a fixed-cutter bit and a roller cone bit and cutting elements for such bits, additional examples of earth-boring tools that may utilize cutting elements according to the present invention include, but are not limited to, impregnated diamond bits, coring bits, bi-center bits, and reamers (including underreamers).

While the invention may be susceptible to various modifications and alternative forms, specific embodiments of which have been shown by way of example in the drawings and have been described in detail herein, it should be understood that the invention is not intended to be limited to the particular forms disclosed. Rather, the invention includes all modifications, equivalents, and alternatives falling within the scope of the invention as defined by the following appended claims and their legal equivalents.

What is claimed is:

1. An earth-boring tool, comprising at least one cutting element secured to a blade or a roller cone of the earth-boring tool, the at least one cutting element comprising at least one grading feature in or on the at least one cutting element and positioned a known distance from an initial working surface of the at least one cutting element, the position of the at least one grading feature selected to facilitate the determination of a dull grade upon wear of the at least one cutting element, wherein the at least one grading feature comprises a first material volume and at least one second material volume adjacent the first material volume, and wherein an interface between the first material volume and the at least one second material volume is substantially perpendicular to a longitudinal axis of the at least one cutting element.

2. The earth-boring tool of claim 1, wherein the at least one second material volume is visually distinct from the first material volume.

3. The earth-boring tool of claim 1, wherein the first material volume and the at least one second material volume each comprise a volume of hardfacing material.

4. The earth-boring tool of claim 1, wherein at least one of the first material volume and the at least one second material volume comprises a film.

5. The earth-boring tool of claim 1, wherein the at least one second material volume exhibits a color differing from a color exhibited by the first material volume.

6. The earth-boring tool of claim 1, wherein the at least one cutting element comprises an arcuate end surface.

7. The earth-boring tool of claim 1, wherein the at least one grading feature further comprises a third material volume adjacent the at least one second material volume.

8. The earth-boring tool of claim 7, wherein the at least one grading feature further comprises a fourth material volume adjacent the third material volume.

9. The earth-boring tool of claim 8, wherein non-adjacent material volumes of the first material volume, the at least one second material volume, the third material volume, and the fourth material volume comprise visually identical material.

10. The earth-boring tool of claim 1, wherein the at least one cutting element further comprises a superabrasive material at least partially covering the at least one grading feature.

11. A cutting insert for an earth-boring tool, comprising:

a body having a substantially planar cutting face surface and a substantially cylindrical side surface, the body comprises a base sized and configured to be received in an aperture in the earth-boring tool; and at least one grading feature comprising at least one interface between at least two adjacent material volumes within the cutting insert, each of the at least two adjacent material volumes being at least substantially planar and oriented perpendicular to a major axis of the body, the at least one grading feature positioned at a predetermined distance from an initial working surface of the body, the position of the at least one grading feature selected to facilitate the determination of a dull grade upon wear of the cutting insert.

12. The cutting insert of claim 11, wherein the at least two adjacent material volumes comprise visually distinct material volumes.

13. The cutting insert of claim 12, wherein each of the at least two adjacent and visually distinct material volumes comprises an inorganic pigment comprising an oxide of one or more transition metals selected from the group consisting of chromium, cobalt, copper, nickel, iron, titanium, and manganese.

14. The cutting insert of claim 11, wherein the at least two adjacent material volumes comprise a first substantially planar layer of material and a second substantially planar layer of material disposed adjacent the first substantially planar layer of material.

15. The cutting insert of claim 11, wherein each material volume of the at least two adjacent material volumes has a substantially similar thickness.

16. The cutting insert of claim 11, wherein the at least two adjacent material volumes comprise a plurality of alternating first material volumes and second material volumes.

17. A cone for an earth-boring bit, comprising:

a cone body;

a plurality of teeth, each tooth having a base and a tip, the tip of each tooth being located distal to the cone body; and at least one grading feature comprising an interface between a first material volume and a second material volume in or on an exterior surface of at least one tooth of the plurality of teeth, the at least one grading feature being oriented substantially perpendicular to an axis extending from the base to the tip, the at least one grading feature being located a known distance from at least one of the tip and the base, the location of the at least one grading feature selected to facilitate the determination of a dull grade upon wear of the at least one tooth.

18. The cone of claim 17, wherein the first material volume comprises a first volume of hardfacing material and the second material volume comprises a second volume of hardfacing material.

19. The cone of claim 17, wherein at least one of the first material volume and the second material volume comprises a pigment such that the second material volume exhibits a color that is different than a color exhibited by the first material volume.

20. An earth-boring tool, comprising:

a body comprising a face region; and a plurality of cutting elements secured to the face region of the body, each cutting element of the plurality of cutting elements comprising at least one grading feature positioned a known distance from an initial working surface of the cutting element, wherein the at least one grading feature comprises a first material volume and at least one second material volume adjacent the first material volume, an interface between the first material volume and the at least one second material volume being oriented substantially perpendicular to a longitudinal axis of the cutting element, the at least one second material volume being visually distinct from the first material volume.

21. The earth-boring tool of claim 20, wherein the at least one second material volume of each cutting element of the plurality of cutting elements exhibits a color differing from a color exhibited by the corresponding first material volume.

22. A cutting insert for an earth-boring tool, comprising:

a body having a substantially planar cutting face surface and a substantially cylindrical side surface; and a plurality of grading features positioned on at least one of the cutting face surface and the side surface at a predetermined distance from an initial working surface of the body; and wherein each grading feature of the plurality of grading features comprises an interface between two adjacent and visually distinct material volumes within the cutting insert, the interface of each grading feature being oriented substantially perpendicular to a longitudinal axis of the cutting insert.

23. The cutting insert of claim 22, wherein the cutting insert comprises a first substantially planar layer of material, a second substantially planar layer of material disposed adjacent the first substantially planar layer of material, and a third substantially planar layer of material disposed adjacent the second substantially planar layer of material.

24. A cone for an earth-boring bit, comprising:

a cone body;

a plurality of teeth, each tooth having a base and a tip, the tip of each tooth being located distal to the cone body; and at least one grading feature in or on an exterior surface of at least one tooth of the plurality of teeth, the at least one grading feature being located a known distance from at least one of the tip and the base; and wherein the at least one grading feature comprises an interface between a first volume of hardfacing material and a second volume of hardfacing material, the interface oriented substantially parallel to the base of the at least one tooth of the plurality of teeth.

* * * * *